US007796905B2

(12) United States Patent
Honda et al.

(10) Patent No.: US 7,796,905 B2
(45) Date of Patent: Sep. 14, 2010

(54) MULTICOLOR IMAGE FORMING APPARATUS

(75) Inventors: Haruyuki Honda, Ibaraki (JP); Masahiko Saito, Ibaraki (JP); Masanari Fujita, Ibaraki (JP); Masashi Yamamoto, Ibaraki (JP); Yasuo Takuma, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 708 days.

(21) Appl. No.: 11/490,200

(22) Filed: Jul. 21, 2006

(65) Prior Publication Data

US 2007/0031167 A1 Feb. 8, 2007

(30) Foreign Application Priority Data

Jul. 22, 2005 (JP) ..... P2005-212791

(51) Int. Cl.
*G03G 15/01* (2006.01)

(52) U.S. Cl. ..... 399/54; 388/228

(58) Field of Classification Search ..... 399/43, 399/45, 54, 162, 223, 226, 227, 228, 265, 399/267, 279

See application file for complete search history.

(56) References Cited

U.S. PATENT DOCUMENTS 4,847,660 A * 7/1989 Wheatley et al. ..... 399/167
4,999,680 A * 3/1991 Joseph et al. ..... 399/119
5,132,733 A * 7/1992 Koizumi et al. ..... 399/228
5,138,398 A * 8/1992 Yamada ..... 399/226
5,160,969 A * 11/1992 Mizuma et al. ..... 399/223
6,600,889 B2 * 7/2003 Hiroki et al. ..... 399/228
2003/0147672 A1 * 8/2003 Ahn ..... 399/228

FOREIGN PATENT DOCUMENTS

JP 02061662 A * 3/1990
JP 06138759 A * 5/1994
JP 2002311707 A * 10/2002
JP 2006-243014 9/2006

* cited by examiner

*Primary Examiner*—Robert Beatty
(74) *Attorney, Agent, or Firm*—McGinn IP Law Group, PLLC

(57) ABSTRACT

A multicolor image forming apparatus includes: a photosensitive belt unit comprising; a driving roller; a driven roller; a photosensitive belt having a joint, and a charger charging a surface of the photosensitive belt; an exposure device forming an electrostatic latent image, based on image information of each color, on the photosensitive belt; a plurality of developing devices storing different color developers, and an intermediate transfer unit performing a first transfer by sequentially superimposing each color developer image formed on the photosensitive belt. The photosensitive belt is suspended around the driving roller and the driven roller and is rotated and driven by the driving roller. Each developing device contacts and retracts from the photosensitive belt so as to develop the electrostatic latent image into a visible image using each color developer. At least one developing device can retract from the photosensitive belt at a region other than an image region.

22 Claims, 4 Drawing Sheets

MULTICOLOR IMAGE FORMING APPARATUS

CROSS-REFERENCE TO RELATED APPLICATION

This application is based on and claims the benefit of priority from the prior Japanese Patent Application No. 2005-212791, filed on Jul. 22, 2005; the entire contents of which are incorporated herein by reference.

TECHNICAL FIELD

The present invention relates to a multicolor image forming apparatus, and more specifically relates to a multicolor image forming apparatus which forms a multicolor image by superimposing a plurality of color toner images, by xerography, based on a print signal transmitted from a host device.

BACKGROUND

In an image forming apparatus, a photosensitive belt unit is important in terms of print quality and running cost. When a pressing against and retraction from a photosensitive belt by a developing device is repeatedly carried out at a specific position on the photosensitive belt, an abrasion, caused by a pressing and retraction of a development roller of the developing device, occurs at a specific position on a surface of the photosensitive belt. When printing of A4 size (a paper length of 297 mm) is continuously carried out, the developing device repeatedly contacts and retracts from the photosensitive belt before or after an A4 size image region, thereby scratching a surface of the photosensitive belt before or after the A4 size image region. Thereafter, when printing of legal size (a paper length of 356 mm) which has a longer image region than the A4 size one is carried out, the scratch made on the photosensitive belt enters the image region, and the trace of the scratch on the photosensitive belt appears in a printed image.

In the related art, in order to prevent the image defect, the range in which the developing device is brought into contact with the photosensitive belt is made wider than a maximum image region of the specifications of a multicolor image forming apparatus, thereby preventing an effect of the abrasion on the photosensitive belt from appearing in the image.

FIG. 4 is a view showing a region in which a developing device in the existing multicolor image forming apparatus is pressed against a photosensitive belt. A developing device pressing region 26, in which a contact starts at a contact start position 28 and ends at a contact end position 27, is set to one and the same fixed place which is wider than a maximum image region and narrower than a portion between joints 19 and 19. The reason is to prevent the occurrence of an image defect resulting from abrasions 23 which occur at the contact start position 28 and the contact end position 27 on the photosensitive belt 2.

FIG. 5 is a sectional view of an aged condition of the contact start position and the contact end position on the photosensitive belt 2 in the existing method. The photosensitive belt 2 includes a substrate 30, an evaporated aluminum layer 31 and an organic photoconductive layer 32. When the abrasions 23 on the photosensitive belt 2 become deep, they pass through the organic photoconductive layer 32 and reach the evaporated aluminum layer 31. This causes dielectric breakdown in the portion of the abrasions 23, thus disabling a printing operation.

SUMMARY

As described heretofore, in the related art, as the contact and retraction of the developing device from the photoconductor is repeated in one and the same place, the photoconductive layer of the photosensitive belt eccentrically wears, thereby seriously preventing an increase in the lifetime of the photosensitive belt.

It is an object of the invention to provide a multicolor image forming apparatus in which eccentric wear, which occurs in a developing device contact start position and a developing device contact end position on a photosensitive belt, is suppressed to achieve an increase in the lifetime of the photosensitive belt, thereby reducing a running cost.

According to an aspect of the invention, a multicolor image forming apparatus includes: a photosensitive belt unit comprising; a driving roller; a driven roller; a photosensitive belt having a joint, and a charger charging a surface of the photosensitive belt; an exposure device forming an electrostatic latent image, based on image information of each color, on the photosensitive belt; a plurality of developing devices storing different color developers, and an intermediate transfer unit performing a first transfer by sequentially superimposing each color developer image formed on the photosensitive belt. The photosensitive belt is suspended around the driving roller and the driven roller and is rotated and driven by the driving roller. Each developing device contacts and retracts from the photosensitive belt so as to develop the electrostatic latent image into a visible image using each color developer. At least one developing device can retract from the photosensitive belt at arbitrarily region other than an image region.

BRIEF DESCRIPTION OF THE DRAWING

These and other objects and advantages of this invention will become more fully apparent from the following detailed description taken with the accompanying drawings in which.

DESCRIPTION OF THE EMBODIMENTS

An embodiment of the invention will hereafter be described with reference to the drawings.

Figure 1:
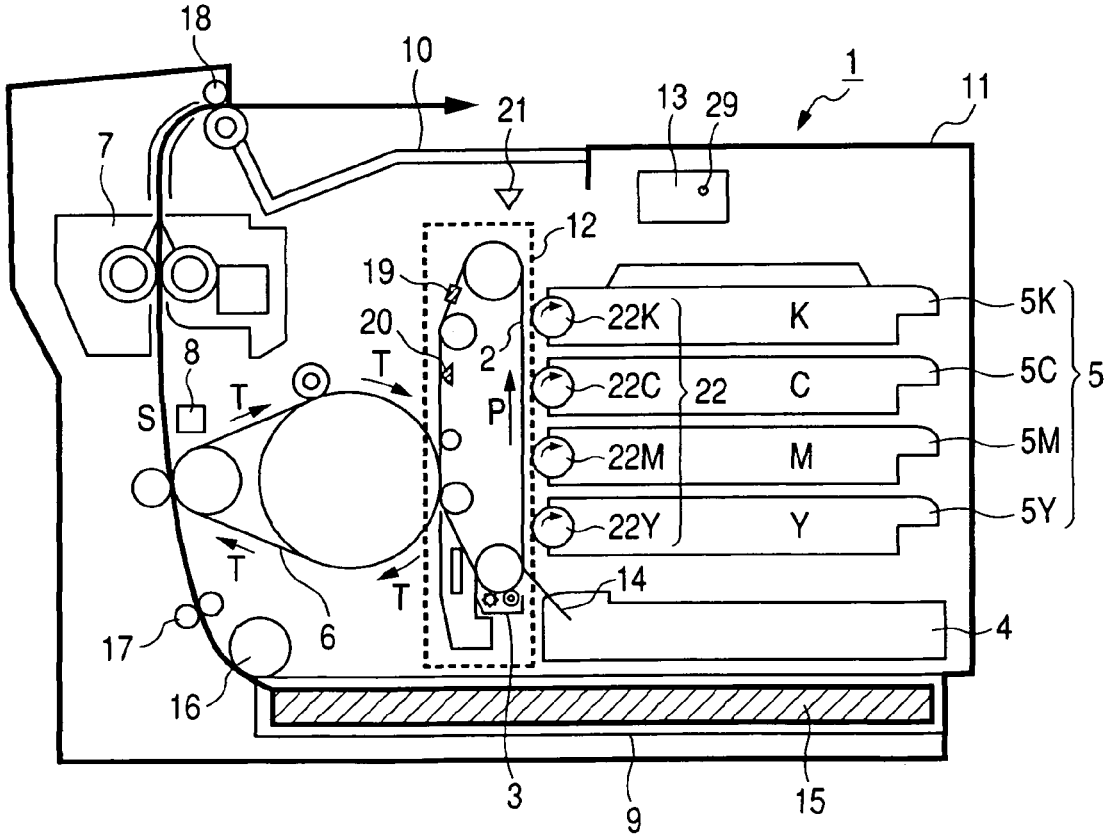
FIG. 1 is a schematic view of a full-color printer according to an embodiment of the invention.

The embodiment will be described illustrating an image forming apparatus of a full-color laser printer. In FIG. 1, a printer 1 includes a photosensitive belt 2, a contact charger 3, an exposure device 4, a development machine 5, an intermediate transfer belt 6, a fuser 7, a static eliminator 8, a paper feeding cassette 9, a paper discharge tray 10 and a casing 11.

The photosensitive belt 2 and the contact charger 3 constitute a photoconductor unit 12 which can be attached and detached from the printer 1.

When a computing unit 13 issues a printing process start instruction, first, the contact charger 3 comes into contact with a surface of the photosensitive belt 2, thereby uniformly charging the surface of the photosensitive belt 2. Subsequently, the exposure device 4 exposes the surface of the photosensitive belt 2 to a laser beam 14, thereby forming an electrostatic latent image on the surface of the photosensitive belt 2. Subsequently, the development machine 5 develops the electrostatic latent image formed on the surface of the photosensitive belt 2 into a visible image by using a toner to form a toner image on the surface of the photosensitive belt 2. Subsequently, the toner image is transferred from the surface of the photosensitive belt 2, which revolves in a P direction in the figure, to a surface of the intermediate transfer belt 6, which revolves in a T direction in the figure. The above cycle is repeatedly executed for each of the color toners yellow (Y) toner, magenta (M) toner, cyan (C) toner and black (K) toner, thus forming a toner image with a Y toner image, an M toner image, a C toner image and a K toner image superimposed on the surface of the intermediate transfer belt 6.

Meanwhile, printing paper 15, which is a transfer material, is fed from the paper feeding cassette 9 by a feeding roller 16, and stands by at a registration roller 17. Then, the toner image is transferred from the surface of the intermediate transfer belt 6, which revolves in the T direction in the figure, to a surface of the printing paper 15, which proceeds in an S direction in the figure. Then, the fuser 7 fuses the toner image formed on the surface of the printing paper 15 to the surface of the printing paper 15. Then, the printing paper 15 with an image formed thereon is discharged from a discharge roller 18 to the paper discharge tray 10.

In a case of a plurality of sheets of printing paper, the above printing process is repeatedly executed.

The photosensitive belt 2, having a joint 19 on the surface, has a circumferential length of 380 mm and a circumferential speed of 203 mm/s, and the joint 19 has a width of about 1 mm. Also, the position of the joint 19 is detected by a marker 20, which is located on the photosensitive belt 2 a fixed distance from the joint, a marker detector 21 and the computing unit 13.

Figure 4:
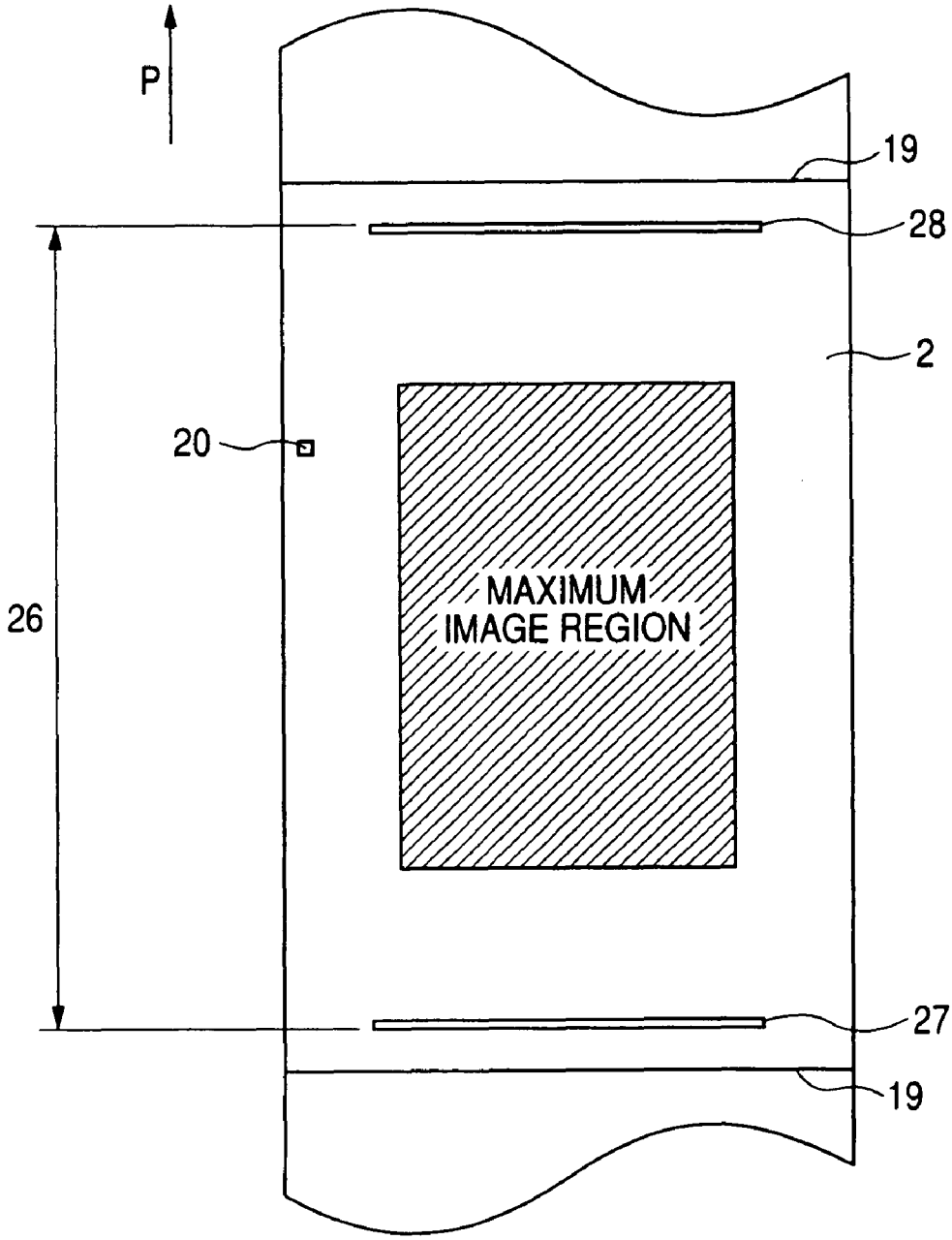
RELATED ART FIG. 4
FIG. 4 is a developed view showing a photosensitive belt when a maximum image region is printed according to a related art.
Figure 5:
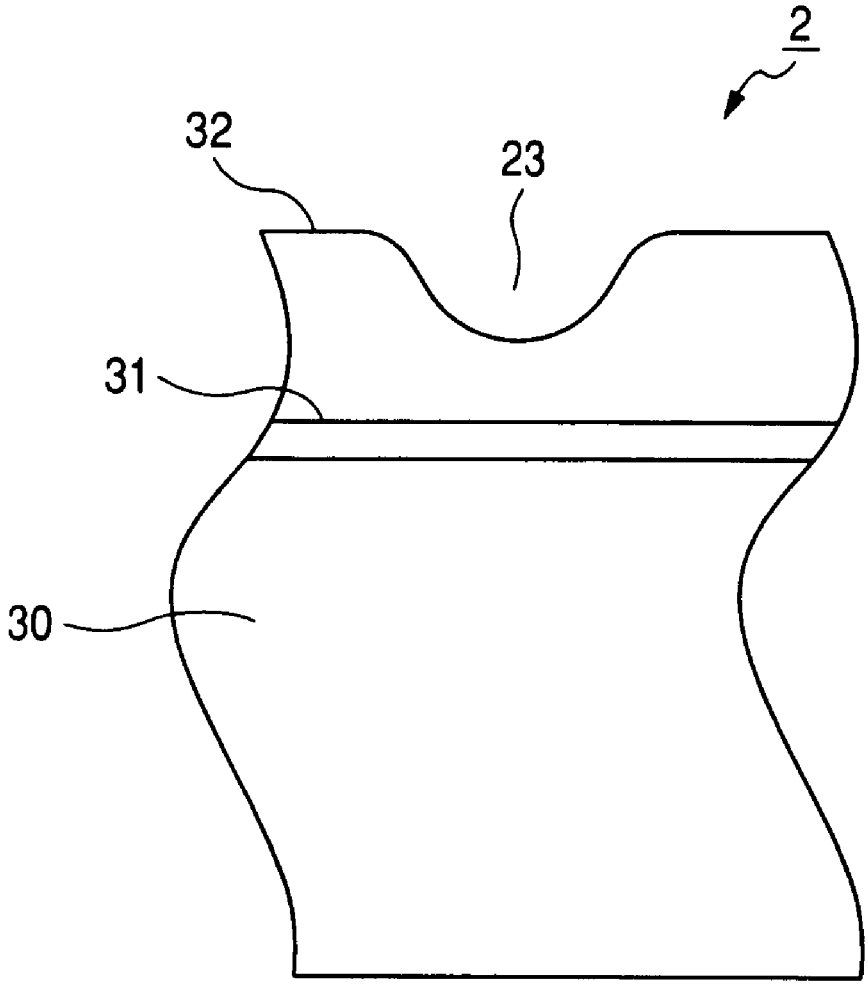
RELATED ART FIG. 5
FIG. 5 is a sectional view of the photosensitive belt in a contact start region and a contact end region according to the related art.

The development machine 5 includes a development roller 22 which is a contact member which makes contact with the photosensitive belt 2. The development roller 22 has a circumferential speed of 304 mm/s. Major causes for the occurrence of abrasions 23 on the surface of the photosensitive belt 2 as shown in FIG. 4 are that the photosensitive belt 2 is formed into a belt and is soft, that the development roller 22 is made of metal and is hard, and that the circumferential speed of the photosensitive belt 2 is different from that of the development roller 22. Particularly at a contact end position, the development roller 22 stops before the photosensitive belt 2 does, thereby increasing a frictional force, so that the abrasions 23 tend to occur noticeably. The abrasions 23 on the surface of the photosensitive belt 23 have a width of about 2 mm.

A description will be given of an image size (paper size) supported by the printer 1. The printer 1 supports an A4 size image, an A3 size image, a B5 size image, a B4 size image, a letter size image and a legal-size image. The A3 size is the largest of the six kinds of image sizes (paper sizes) supported by the printer 1. A user, by setting a desired size paper on the printer and selecting the desired size paper on a printer driver, can print a desired size image on the desired size paper. The image size (paper size) supported by the printer 1 may be other than the above six kinds.

Figure 2:
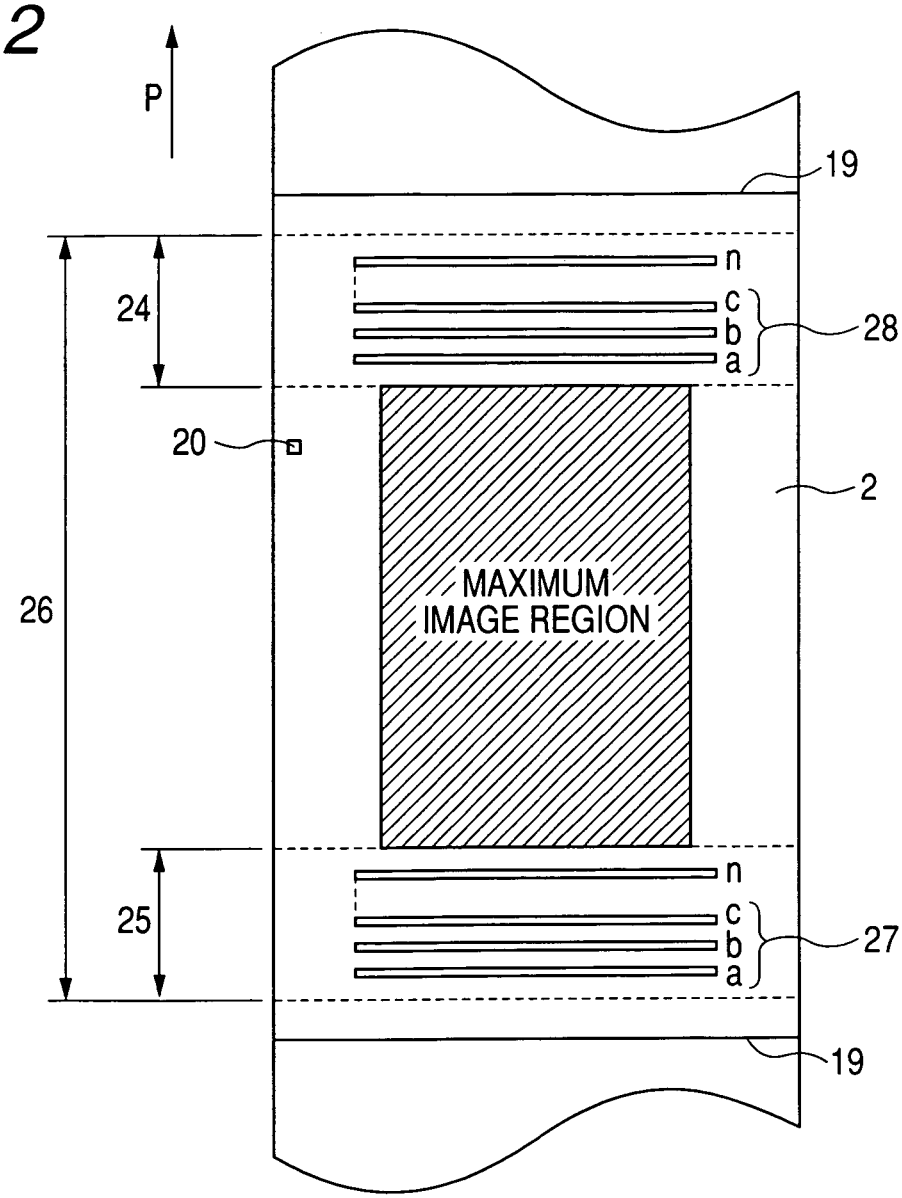
FIG. 2 is a developed view showing a photosensitive belt when a maximum image region is printed according to the embodiment.

FIG. 2 is a developed view representing a condition of the photosensitive belt 2 when a maximum image region is printed. In a case of using the photosensitive belt 2 having the joint, in order to keep the joint 19 off the image region, the photosensitive belt 2 is irradiated with the laser beam 14, starting with the joint 19, at a prescribed timing depending on a paper size to be printed upon, thereby forming an electrostatic latent image. A region with which a developing device 5 starts to come into contact is referred to as a contact start region 24, while a region with which the developing device 5 comes out of contact is referred to as a contact end region 25.

In this embodiment, a plurality of contact end positions 27, a, b, c . . . n, are provided in the contact end region 25. The timings of switching the contact end positions 27 are switched depending on each of a Y toner developing device 5Y, an M toner developing device 5M, a C toner developing device 5C and a K toner developing device 5K, which are executing a contact operation.

Next, a description will be given of several examples of the timing of switching the contact end positions 27 other than the above.

It is also possible to switch the contact end positions 27 in synchronization with a switching of the paper sizes (A4 size, A3 size, B5 size, B4 size, letter size and legal size).

It is also possible to switch the contact end positions 27 for each print job.

It is possible to switch the contact end positions 27 for each number of pages printed. In the event that the computing unit 13 issues an instruction to print A pages, the computing unit 13 executes a calculation of A/n=C (where C is an integer and the remainder is D), and obtains C pages as the number of active pages per contact end position 27. Then, the computing unit 13 records the contact end positions 27 of the previous job for the contact end positions 27 of the remaining D pages, and makes changes in order for each print job. It is possible to switch the contact end positions 27 for each print image in the same way as for each print page.

In addition to the timing of switching the contact end positions 27 shown above by several examples, a description will be given of the case in which the computing unit 13 includes therein a counter 29 which can record a cumulative number of contact ends for each contact end position 27, and can thus average the number of contact ends for each contact end position 27.

Figure 3:
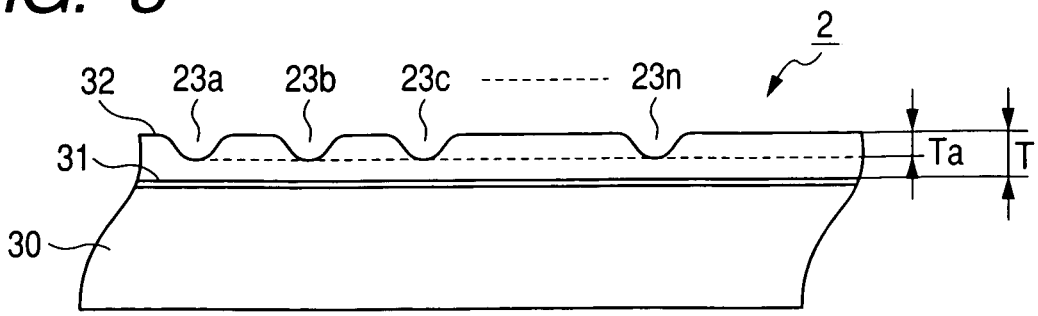
FIG. 3 is a sectional view of the photosensitive belt in a contact start region and a contact end region according to the embodiment.

FIG. 3 is a view showing a section of the photosensitive belt in the contact start region and the contact end region according to the embodiment. The photosensitive belt 2 includes a substrate 30, an evaporated aluminum layer 31 and an organic photoconductive layer 32. The thickness of the organic photoconductive layer 32 is indicated by T. The depth of the abrasions in a plurality n of the contact end positions 27 is indicated by Ta. The depth at which the development machine 5 scrapes the organic photoconductive layer 32 each time it retracts from the photosensitive belt 2 is indicated by Tb. As the lifetime of the photosensitive belt 2 is determined by the fact that the abrasion depth Ta reaches the evaporated aluminum layer 31 (T−Ta=0) and undergoes dielectric breakdown, the number of contact ends K becomes K=T/Tb×n.

It is now supposed that n=1. The lifetime value of the photosensitive belt then becomes T/Tb. That is, this is the lifetime value of the related art. Consequently, the contact end region 25 includes therein the plurality n of the contact end positions 27, thereby making it possible to increase the lifetime by n times in comparison with the related art.

The above description is applied not only to the case in which the contact end region 25 includes therein the plurality n of the contact end positions 27, but also to the case in which the contact start region 24 includes therein a plurality n of contact start positions 28.

As above, a plurality of the contact end positions 27 and the contact start positions 28 are provided, thereby making it possible to increase the lifetime of the photosensitive belt 2 and to provide a multicolor image forming apparatus which is low in running cost.

According to the above-embodiment, it is possible to avoid local eccentric wear of the photosensitive belt, which is caused by the developing device, and thus to realize an increase in lifetime, thereby making it possible to provide a multicolor image forming apparatus which is low in running cost.

What is claimed is:

1. A multicolor image forming apparatus comprising:

a photosensitive belt unit comprising:

a driving roller;

a driven roller;

a photosensitive belt including a joint, the photosensitive belt being suspended around the driving roller and the driven roller and being rotated and driven by the driving roller; and a charger charging a surface of the photosensitive belt;

an exposure device forming an electrostatic latent image, based on image information of each color, on the photosensitive belt;

a plurality of developing devices storing a plurality of different color developers, the plurality of developing devices contacting and retracting from the photosensitive belt so as to develop the electrostatic latent image into a visible image using the plurality of different color developers; and an intermediate transfer unit performing a first transfer by sequentially superimposing each visible image formed on the photosensitive belt, wherein at least one developing device of the plurality of developing devices retracts from the photosensitive belt at a region which is a distance from an image region being printed by the one developing device of the plurality of developing devices, and wherein the one developing device of the plurality of developing devices retracts from the photosensitive belt at another region which is a different distance from the image region being printed by the one developing device of the plurality of developing devices.

2. A multicolor image forming apparatus according to claim 1, wherein at least one developing device of the plurality of developing devices contacts the photosensitive belt at a region other than the image region.

3. A multicolor image forming apparatus according to claim 1, wherein a position at which at least one developing device of the plurality of developing devices contacts and retracts from the photosensitive belt is changed for each developing device of the plurality of developing devices.

4. A multicolor image forming apparatus according to claim 1, wherein a position at which at least one developing device of the plurality of developing devices contacts and retracts from the photosensitive belt is changed for each size of paper to be printed upon.

5. A multicolor image forming apparatus according to claim 1, wherein a position at which at least one developing device of the plurality of developing devices contacts and retracts from the photosensitive belt is changed for each print job.

6. A multicolor image forming apparatus according to claim 1, wherein a position at which at least one developing device of the plurality of developing devices contacts and retracts from the photosensitive belt is changed for each number of pages to be printed.

7. A multicolor image forming apparatus according to claim 1, wherein a position at which the one developing device of the plurality of developing devices contacts and retracts from the photosensitive belt is changed for each number of images to be printed.

8. A multicolor image forming apparatus according to claim 1, wherein a cumulative number of contacts and retractions at each position of a plurality of positions at which at least the one developing device of the plurality of developing devices contacts and retracts from the photosensitive belt is determined, and wherein the one developing device of the plurality of developing devices contacts and retracts from the photosensitive belt such that the number of contacts and retractions at each position is averaged.

9. A multicolor image forming apparatus according to claim 1, wherein at least one developing device of the plurality of developing devices contacts the photosensitive belt at a region other than the image region, and wherein at least the one developing device of the plurality of developing devices or another developing device of the plurality of developing devices contacts the photosensitive belt at another region other than the image region.

10. A multicolor image forming apparatus according to claim 1, wherein a plurality of positions at which at least the one developing device of the plurality of developing devices contacts the photosensitive belt is changed for another developing device of the plurality of developing devices.

11. A multicolor image forming apparatus according to claim 1, wherein a position at which at least the one developing device of the plurality of developing devices contacts the photosensitive belt is changed based on a size of paper to be printed upon.

12. A multicolor image forming apparatus according to claim 1, wherein a plurality of positions at which at least the one developing device of the plurality of developing devices contacts the photosensitive belt is changed for another print job.

13. A multicolor image forming apparatus according to claim 1, wherein the one developing device of the plurality of developing devices retracts from the photosensitive belt at another region other than the image region.

14. A multicolor image forming apparatus according to claim 1, wherein another developing device of the plurality of developing devices retracts from the photosensitive belt at another region other than the image region.

15. A multicolor image forming apparatus according to claim 1, wherein a position of the joint is detected based on a marker disposed on the photosensitive belt and a marker detector, and wherein the electrostatic latent image is formed relative to the joint based upon a paper size to be printed on.

16. A multicolor image forming apparatus according to claim 1, further comprising a counter configured to record a cumulative number of retractions at each region.

17. An image forming apparatus comprising:

a photosensitive belt unit;

an exposure device forming an electrostatic latent image on the photosensitive belt; and a developing device contacting and retracting from the photosensitive belt so as to develop the electrostatic latent image into a visible image, wherein the developing device retracts from the photosensitive belt at a region which is a distance from an image region being printed by the developing device, and wherein the developing device retracts from the photosensitive belt at another region which is a different distance from the image region being printed by the developing device.

18. A multicolor image forming apparatus according to claim 17, wherein, regarding a plurality of positions at which the developing device contacts the photosensitive belt, a cumulative number of contacts at each position is recorded, and wherein the developing device contacts the photosensitive belt such that the number of contacts at each position is averaged.

19. A multicolor image forming apparatus according to claim 17, wherein a plurality of positions at which the developing device contacts the photosensitive belt is changed for each number of pages to be printed.

20. A method of forming a multicolored image, comprising:

exposing an electrostatic latent image on a photosensitive belt;

contacting the photosensitive belt with one developing device of a plurality of developing devices to develop the electrostatic latent image into a visible image;

retracting the one developing device of the plurality of developing devices from the photosensitive belt at a region which is a distance from an image region being printed by the one developing device of the plurality of developing devices; and retracting from the photosensitive belt at least the one developing device of the plurality of developing devices at another region which is a different distance from the image region being printed by the one developing device of the plurality of developing devices.

21. A method of forming a multicolored image according to claim 20, wherein a position at which at least the one developing device of the plurality of developing devices contacts the photosensitive belt is changed for another developing device of the plurality of developing devices.

22. A method of forming a multicolored image according to claim 20, wherein a cumulative number of extensions and retractions are recorded at each position of a plurality of positions at which at least the one developing device of the plurality of developing devices contacts the photosensitive belt, and wherein the one developing device of the plurality of developing devices contacts the photosensitive belt such that the number of contacts at each position is averaged.

* * * * *